US011986074B1

(12) United States Patent
Freeland

(10) Patent No.: US 11,986,074 B1
(45) Date of Patent: May 21, 2024

(54) TREAT CARRIER THAT PROJECTS DECORATIVE SILHOUETTES

(71) Applicant: Brian Freeland, Chandler, AZ (US)

(72) Inventor: Brian Freeland, Chandler, AZ (US)

( * ) Notice: Subject to any disclaimer, the term of this patent is extended or adjusted under 35 U.S.C. 154(b) by 0 days.

(21) Appl. No.: 18/230,108

(22) Filed: Aug. 3, 2023

(51) Int. Cl.
*A45C 15/06* (2006.01)

(52) U.S. Cl.
CPC ..... *A45C 15/06* (2013.01)

(58) Field of Classification Search
CPC ..... A45C 15/06
See application file for complete search history.

(56) References Cited

U.S. PATENT DOCUMENTS 4,698,732 A 10/1987 Hickey
4,714,985 A 12/1987 Hickey et al.
4,802,071 A 1/1989 Schuster
4,926,296 A * 5/1990 Blume ..... A45C 15/06 428/34.3
5,467,918 A 11/1995 Glover
5,597,230 A 1/1997 Newman
5,984,754 A 11/1999 Freelander
6,092,905 A * 7/2000 Koehn ..... B60N 3/101 362/101
6,200,000 B1 * 3/2001 Burnidge ..... A45C 15/06 362/249.05
6,224,234 B1 5/2001 Demmery
6,270,233 B1 8/2001 Holland
6,619,810 B2 9/2003 Kramer et al.
6,789,932 B2 9/2004 Healy
6,869,199 B1 * 3/2005 Burnidge ..... F21V 33/0028 362/109
7,311,415 B1 12/2007 Burnidge
8,579,459 B2 11/2013 Ma et al.
(Continued)

FOREIGN PATENT DOCUMENTS

CN 201257301 Y 6/2009
KR 200452205 Y1 2/2011

OTHER PUBLICATIONS

US Trademark Registration No. 4145999; Mark—Blazing Ledz Filing date: Sep. 16, 2011 Registration date: May 22, 2012.
(Continued)

*Primary Examiner* — Thomas M Sember
(74) *Attorney, Agent, or Firm* — LEGALFORCE RAPC WORLDWIDE

(57) ABSTRACT

Treat carriers and methods of manufacture of the same are described, and more particularly to a holiday treat carrier in the form of a lighted bucket, and its associated methods of manufacture. In one embodiment, a treat carrier includes a bucket formed of a translucent material in which a light source illuminates the bucket interiorly and exteriorly. A single mold process may be used to form the bucket when the translucent material is manipulated in a form of the bucket. Decorative openings permit the light to pass through to a region exterior to the bucket, and generate a decorative projected silhouette that emanates from the exterior wall of the bucket and projects to surrounding areas. At least one light-emitting diode affixed in an interior portion of a top region of the bucket serves as the light source. The light-emitting diode is placed within a cavity formed through the single process mold.

24 Claims, 12 Drawing Sheets

(56) References Cited

U.S. PATENT DOCUMENTS

| | | | |
|---|---|---|---|
| 9,022,595 | B1 | 5/2015 | Schilling et al. |
| 9,181,023 | B2 | 11/2015 | Clinton |
| 2003/0086260 | A1 | 5/2003 | Terrell et al. |
| 2005/0045513 | A1 | 3/2005 | Won et al. |
| 2016/0010844 | A1 | 1/2016 | Ma |
| 2019/0183061 | A1 | 6/2019 | Huang |

OTHER PUBLICATIONS

US Trademark Registration No. 5412918; Mark—Shawshank Ledz Filing date: Aug. 9, 2017 Registration date: Feb. 27, 2018.
US Trademark Registration No. 4244511; Mark—Blacklight Master Filing date: Sep. 16, 2011 Registration date: Nov. 20, 2012.
US Trademark Registration No. 4025874; Mark—Scorpion Master Filing date: Feb. 16, 2011 Registration date: Sep. 13, 2011.
"Spider Web LED Projection Bucket", by Shawshank Ledz, Published Online in [Dec. 2022] https://shawshankledz.com/images/P/768175-Hal%20SpiderWeb%20Projection%20LIT%20Bucket%20HiRes.jpg.
"Pumpkin Light Handle Halloween Buckets", by FlashingBlinkyLights, Found Online on [Sep. 8, 2023] https://www.flashingblinkylights.com/media/catalog/product/1/2/12328_halloween_pumpkin_buckets_frontv1_750.gif.
"Halloween candy bucket Light up Pail blow mold", by Ningbo, Published Online on [Sep. 9, 2020] https://m.media-amazon.com/images/1/81Du-nGIK9L._ AC_SY741_.jpg.
"Halloween Pumpkin Bucket, Light Up Pumpkin Bucket", by Toyandona, Published Online on [Aug. 4, 2022] https://m.media-amazon.com/images/l/51nlt0lyR6L._AC_SX569_.jpg.
"Halloween Flash Light Up Orange Pumpkin Jack O Lantern Trick Or Treat Bucket", by Kid Fun, Found Online on [Sep. 8, 2023] https://i.ebayimg.com/images/g/d34AAOSwMv5j7~3u/s-I1600.jpg.
"Led Light-up Halloween Bucket", by Rise, Found Online on [Sep. 8, 2023] https://s.alicdn.com/@sc04/kf/HTB1DiJzIOMnBKNjSZFCq6x0KFXah.jpg_960x960.jpg.
"Light Up Teal Pumpkin Halloween Felt Trick or Treat Bucket", by Six Senses Media, Found Online on [Sep. 8, 2023] https://m.media-amazon.com/images/l/61h5+rBHeCL._ AC_SX679_. jpg.
"The Electric Mammoth Light Up Trick or Treat Halloween Pumpkin Bucket ", by The Electric Mammoth, Published Online on [Aug. 22, 2019] https://m.media-amazon.com/images/l/511AbKLUFwL._AC_SX569_.jpg.
"Way to Celebrate Halloween Blue Light-Up Bucket Led Light Battery Operated", by Way to Celebrate, Found Online on [Sep. 8, 2023] https://i5.walmartimages.com/seo/Way-to-Celebrate-Halloween-Blue-Light-Up-Bucket-Led-Light-Battery-Operated_4edecfa1-0fcc-4d43-a259-f1808d0dfedb_1.1bfa3cd8d6c0ef0b229a4f20ec1ab96e.jpeg?odnHeight=2000&odnWidth=2000&odnBg=FFFFFF.

* cited by examiner

TREAT CARRIER THAT PROJECTS DECORATIVE SILHOUETTES

FIELD OF TECHNOLOGY

This disclosure relates generally to the field of treat carriers and methods of manufacture of the same, and more particularly to a holiday treat carrier in the form of a lighted bucket, and its associated methods of manufacture.

BACKGROUND

A holiday bucket may be designed to carry and/or transport holiday items such as candy, toys, and/or other gifts from neighbors. Candy may not be safe, and may create allergies when deposited into the bucket. As a result, the child may accidentally consume candies that are harmful to them.

In addition, Halloween night can be busy, with increased vehicle and foot traffic on a residential road. A child may be excited and therefore may not always pay attention to his/her surroundings. The child may not know a rule about road safety (e.g., such as looking both ways before crossing a residential street, using designated crosswalks, and staying on sidewalks).

The child's visibility on the residential street may be limited as caused by poor lighting. Insufficient or inadequate lighting on the residential street can make it difficult for the driver to see the child, especially during the darker evening hours of Halloween. Dimly lit areas, broken streetlights, and/or areas without streetlights altogether can create visibility challenges for both the driver and the child.

Moreover, keeping with a ghoulish theme of the Halloween holiday, the child may wear a costume and/or clothing that is dark in color. This can decrease visibility, and the child may blend into a surrounding, making it harder for the driver to spot the child. This is particularly problematic at Halloween night when there may be limited ambient light.

Obstructions such as parked cars, overgrown vegetation, and/or other obstacles near sidewalks can obstruct the view of the child, reducing visibility and increasing the risk of accidents with the driver. The child and the driver on the residential street may be distracted because of noises, people, costumes, and/or festivities during Halloween night. The driver may be distracted (eg, using their phone and/or engaged in other activities while behind a wheel). Therefore, the driver may not see the child.

For example, the driver may be traveling at a high speed on the residential street and may have reduced reaction time and may not have enough time to spot and avoid the child, particularly in poorly lit areas or when there are obstructions during Halloween. Adverse weather conditions during the late fall day of Halloween such as rain, fog, and/or snow can further reduce visibility for both the child and the driver, making it more challenging to see and be seen.

As groups of people participate in festivities and move about a neighborhood, a front yard and/or carnival in darkened conditions, the child may be subjected to numerous risks including trips and falls and traffic accidents. Walkways and crowded areas may be difficult for the child to see and perceive because of a lack of light and/or costuming that may be visually obstructive, leading to inadvertent tripping and/or other walking accidents. Likewise, walking along and/or crossing roadways may be dangerous because of lack of light and/or dark costuming that makes the child difficult to see to drivers, leading to avoidable traffic accidents and injury. It may be inconvenient and/or impractical for the child to simultaneously carry a flashlight and the bucket because of limited movement in the costume.

Therefore, the child may be hurt by the driver.

SUMMARY

Treat carriers and methods of manufacture of the same are described, and more particularly to a holiday treat carrier in the form of a lighted bucket, and its associated methods of manufacture.

In one aspect, a treat carrier includes a bucket formed of a translucent material in which a light source within the bucket illuminates the bucket interiorly and exteriorly. The bucket is primarily formed through a single mold process in which the translucent material is manipulated in a form of the bucket. Decorative openings along a surface of an exterior wall permit the light to pass through to a region exterior to the bucket, and which generates a decorative projected silhouette that emanates from the exterior wall of the bucket and projects to areas surrounding the bucket. The treat carrier includes at least one light-emitting diode affixed in an interior portion of a top region of the bucket serving as the light source.

The at least one light-emitting diode is placed within a cavity formed through the single process mold. The treat carrier further includes an electrical wire that transposes within a straw cavity of an upper lining of the bucket. The treat carrier further includes a battery source that provides an electrical current that is carried through the electrical wire to at least one light-emitting diode affixed to the interior portion of the top region of the bucket. One or more of the light-emitting diodes are placed in respective cavities which bisect a sectional plane of a circular opening of the bucket and which are approximately 1 pi radians apart from each other.

The treat carrier may include a refraction means on the at least one light-emitting diode to bend a light from the at least one light-emitting diode (e.g., can be a downward fashion). The treat carrier may further include wherein the refraction means on each of the light-emitting diodes bend the light from each of the light-emitting diodes to a focus of the interior of the bucket while permitting the entirety of the bucket to luminesce through the translucent material in which the light from the light-emitting diodes illuminates the bucket interiorly and exteriorly (e.g., whose light emanates through the exterior wall of the bucket).

The treat carrier may further include a plurality of decorative openings formed during the single mold process in which the translucent material is manipulated in the form of the bucket to restrict passage of a holiday item outside the bucket wherein the refraction means to bend a light from the multiple light-emitting diodes in a downward fashion. The treat carrier may further include wherein the plurality of decorative openings transform the light into a kaleidoscopic pattern around a child carrying the bucket during a holiday. The treat carrier may further include wherein the bucket comprises a solid decorative object that may be transposed on the exterior wall that blocks the light from passing through the solid decorative object. The at least one light-emitting diode may have an off mode, a constant on mode, and/or a flashing mode.

The treat carrier may further include a button that may toggle the at least one light-emitting diode between the off mode, the constant on mode, and/or the flashing mode The treat carrier may further include a cover that encloses the straw cavity to encase and protect the electrical wire. The treat carrier may further include a handle that is attached to one of the bucket, the top region of the circular opening of the bucket, and/or the upper rim via a revolute joint. The treat carrier may further include wherein the battery source and/or the at least one light-emitting diode is encased within a housing. The treat carrier may further include at least one frame that encases each of the at least one light-emitting diode wherein the at least one frame is formed to fit into cavities of the apparatus in which the at least one light-emitting diode is affixed In another aspect, a treat carrier comprises a bucket comprising a plurality of decorative openings wherein the openings do not allow a holiday item to pass through. The treat carrier further includes a upper rim formed around a perimeter of a circular opening of the bucket, a straw cavity below the upper rim, a first electrical wire affixed within the straw cavity across the perimeter of the circular opening of the bucket, a first and second cavity oppositely formed in an interior portion of a top region of the circular opening of the bucket, and a battery source affixed to the bucket. The treat carrier further includes a first light-emitting diode embedded within the first cavity wherein the first electrical wire carries power from the battery source to the first light-emitting diode. The first light-emitting diode has a refraction means that bends light to a focus of the interior of the bucket. The treat carrier further includes a second light-emitting diode embedded within the second cavity wherein the first electrical wire carries power from the battery source to the second light-emitting diode, and wherein the second light-emitting diode has a refraction means that bends light to the focus of the interior of the bucket.

The treat carrier may further include a cover that encloses the straw cavity to protect the electrical wire. The treat carrier may further include wherein the bucket, the upper rim, and the cover are formed of a translucent single mold translucent material. The treat carrier may further include a handle that may be attached to one of the bucket, the top region of the circular opening of the bucket, and/or the upper rim via a revolute joint. The treat carrier may further include a second electrical wire that carries power from the battery source to a third light-emitting diode located at the center region of the surface of the bucket. The treat carrier may further include a button that toggles any one of the first light-emitting diode, the second light-emitting diode, and the third light-emitting diode between an off mode, a constant on mode, and/or a flashing mode.

In another aspect, the treat carrier may further comprise a third light-emitting diode located at the center region of the surface of the surface of the bucket. The third light-emitting diode may be powered by a second battery source located at the center region of the bucket. A second button may be located at the center region of the bucket and the second button may toggle the third light-emitting diode between an off mode, a constant on mode, and/or a flashing mode.

The treat carrier may further include wherein the battery source and the first light-emitting diode and/or the second light-emitting diode may be encased within a housing. The treat carrier may further include a first frame that may partially encase the first light-emitting diode, a second frame that may partially encase the second light-emitting diode, and a third frame that may partially encase the third light emitting diode wherein the first frame, the second frame, and the third frame may be formed to fit into the first cavity, the second cavity, and/or a third cavity respectively.

In yet another aspect, a method of manufacturing a treat carrier comprises forming a bucket through a single mold process in which a translucent material is manipulated in a form of the bucket wherein the translucent material is a material in which a light within the bucket illuminates the bucket interiorly and exteriorly (e.g., whose light emanates through the exterior wall of the bucket). The method affixes a plurality of light-emitting diodes in an interior portion of a top region of the bucket. The method then bends the light from each of light-emitting diodes in a downward fashion and channels an electrical wire in a straw cavity of an upper lining of the bucket from a battery source to the plurality of light-emitting diodes.

The method may bend the light from each of the light-emitting diodes to a center region of a surface of the bucket while permitting the entirety of the bucket to luminesce through the translucent material in which the light from the plurality of light-emitting diodes illuminates the bucket interiorly and exteriorly (e.g., whose light emanates through the exterior wall of the bucket). The method may form a plurality of decorative openings during the single mold process in which the translucent material is manipulated in the form of the bucket to restrict passage of a holiday item outside the bucket. The method may permit the light to pass through the plurality of decorative openings to a region exterior to the bucket which may cause the light to scatter into a kaleidoscopic pattern around a child carrying the bucket during a holiday when permitting the light to pass through the plurality of decorative openings to a region exterior to the bucket.

Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

DETAILED DESCRIPTION

Treat carriers and methods of manufacture of the same are described, and more particularly to a holiday treat carrier in the form of a lighted bucket, and its associated methods of manufacture.

Figure 1:
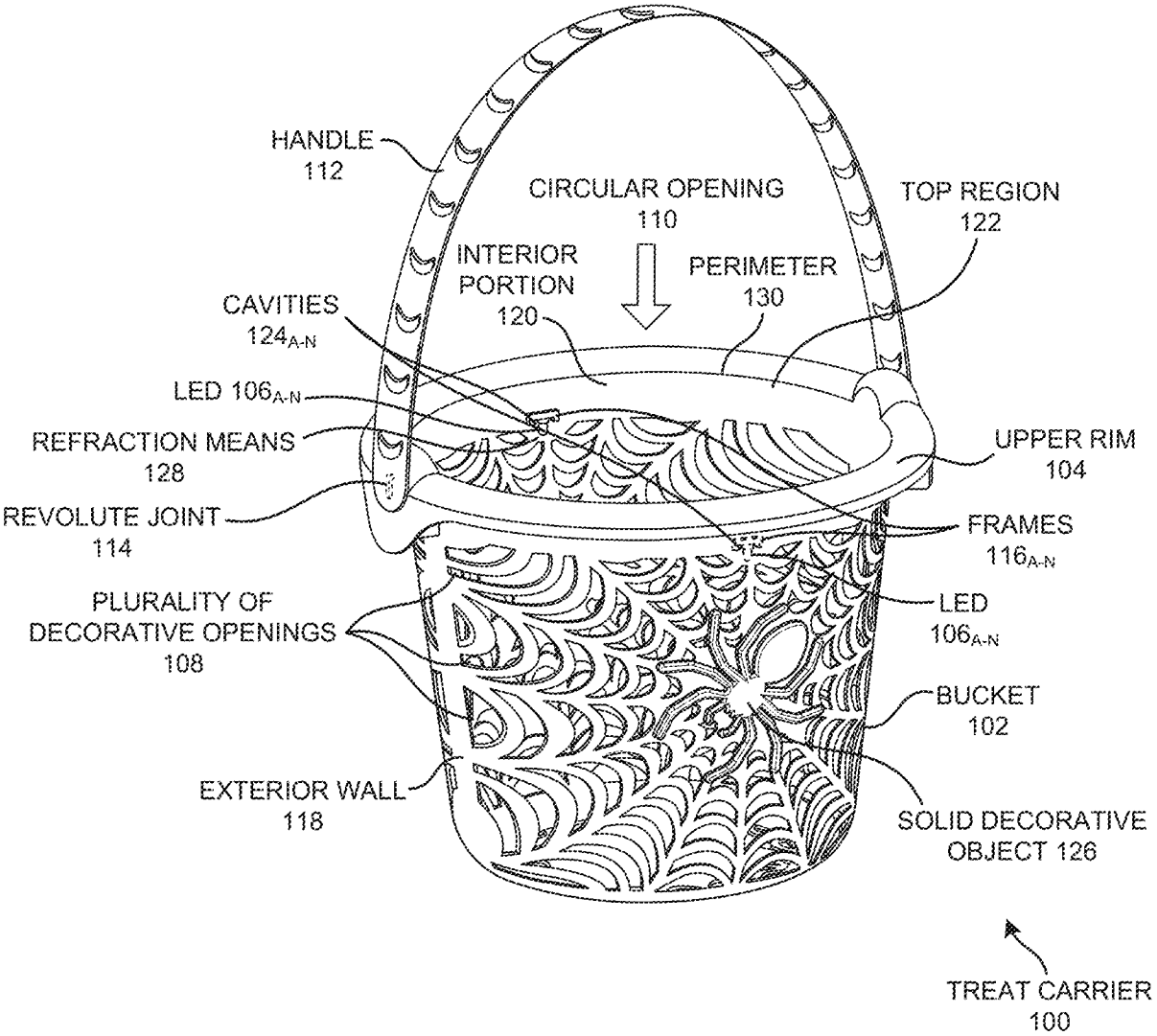
FIG. 1 is a side view of a treat carrier in which a bucket comprises a plurality of decorative openings is situated with a handle, according to one embodiment.

FIG. 1 is a side view of a treat carrier in which a bucket 102 comprises a plurality of decorative openings 108 is situated with a handle 112, according to one embodiment.

FIG. 1 illustrates a treat carrier 100 comprising a bucket 102, a upper rim 104, at least one light-emitting diode (e.g. a LED) 106A-N, a plurality of decorative openings 108 (e.g. holiday themes), circular opening 110, a handle 112, a revolute joint 114, at least one frame 116A-N, an exterior wall 118, an interior portion 120, a top region 122, at least one cavity 124A-N, a solid decorative object 126, a refraction means 128, and a perimeter 130. The theme of the decorative openings may be specifically associated with seasonal holidays, including but not limited to Halloween, Christmas, and Easter or with licensed themes marketed toward seasonal holidays.

The treat carrier 100 may be used by children to carry treats, such as trick-or-treat candies during Halloween that are collected from neighbors or from homes in a neighborhood. The bucket 102 may be formed from a single mold process and may be of a translucent material such as translucent, translucent Terephthalate (PET), Polypropylene (PP), Polycarbonate (PC), Polyvinyl Chloride (PVC), Silicone, Resins, translucent (PE), and/or Thermoplastic Polyurethane (TPU). The upper rim 104 may be created as part of the single mold process and may be curved and/or flat. The least one light-emitting diode (e.g. a LED) 106A-N may be through-hole LEDs, surface mount device (SMD) LEDs, high-power LEDs, RGB LEDs, ultraviolet LEDs, organic LEDs, chip-on-board LEDs filament LEDs, LED strips, miniature LEDs, and/or ceramic LEDs.

The plurality of decorative openings 108 may be formed in the single mold process and may be many different types of holiday-themed orientations including moons, spiders, ghosts, ghouls, stars, bunnies, and/or religious insignia. The circular opening 110 may be the top aperture through which users place holiday items. The handle 112 may be formed of plastic, wire, metal, leather, and/or rope. The revolute joint 114 may be a hinge joint, a fixed revolute joint, a pin joint, a cylindrical joint, a swing arm joint, a spherical joint (e.g. a ball joint), a wrist joint, and/or a finger joint. The frames 116A-B may be formed in the single mold process and/or as an attachment and may be formed of different plastic materials. Furthermore the frames 116A-B may be light fixtures, light panels, light boxes, LED strip profiles, recessed lighting trims, and/or LED channel letters.

The exterior wall 118 may be formed of the single mold process and may comprise any portion of the outer area of the bucket 102. The interior portion 120 may be formed in the single mold process and may comprise any portion of the inner area of the bucket 102. The top region 122 may be formed in the single mold process and may comprise any of the top third of the bucket 102. The cavities 124A-B may be formed in the single mold process and may comprise electrical components and/or structural components. The solid decorative object 126 may be formed in the single mold process and/or added to the bucket via a screw, adhesive, and/or melt bonding. The refraction means 128 may modify a direction of the light from the light source (e.g., the light emitting diodes 106), into the bucket itself, a center of the bucket, a focus of the interior, and/or in a manner that provides optimal visibility to both the materials placed inside the bucket and to the bucket itself when viewed externally. For example, the translucent material may not fully absorb the light from the light source, and the refraction means may provide an angle to the light source to best illuminate exterior walls of the bucket and/or cause silhouetting outside of the bucket. The perimeter 130 may be the partial or whole circumference of any point of the treat carrier 100.

Decorative openings 108 along the surface of the exterior wall 118 permit the light to pass through to a region exterior to the bucket 102, and which generates a decorative projected silhouette 1202 (not shown) that emanates from the exterior wall 118 of the bucket 102 and projects to areas surrounding the bucket 102. The treat carrier 100 includes at least one light-emitting diode 106A affixed in the interior portion 120 of the top region 122 of the bucket 102 serving as the light source. The at least one light-emitting diode 106A is placed within the cavity 124 formed through the single process mold.

According to one or more embodiments, the treat carrier 100 may comprise a bucket 102 formed of a translucent material in which a light source within the bucket 102 illuminates the bucket interiorly and exteriorly and is visible through an exterior wall 118 of the bucket 102. The bucket 102 may be primarily formed through a single mold process in which a translucent material is manipulated in a form of the bucket 102. The handle 112 may be attached to one of the bucket 102, the top region 122 of the circular opening 110 of the bucket 102, and/or the upper rim 104 via a revolute joint 114, which may allow the handle 112 to swivel in a rotational manner.

Serving as the light source, the least one light-emitting diode 106A-N may be affixed in an interior portion 120 of a top region 122 of the bucket 102. The least one light-emitting diode 106A-N may be placed within respective cavities 124A-N. The cavities 124A-N may be formed through the single process mold. The respective cavities 124A-B may bisect a sectional plane of a circular opening 110 of the bucket 102 and may be approximately 1 pi radians apart from each other. The cavities 124A-B may be formed to receive the first and second frames 116A-B respectively. The first frame 116A and the second frame 116B may be formed to fit into the first cavity 124A and the second cavity 124B respectively. The first frame 116A may fully or partially encase the first light-emitting diode 106A and the second frame 116B may fully or partially encase the second light-emitting diode 106B. Furthermore, the frames 116A-B that may encase the least one light-emitting diode 106A-N may be formed to fit into the respective cavities 124A-B to provide protection and support to the light-emitting diodes 106A-B.

Although only one refraction means 128 is illustrated, the refraction means 128 may be attached to any number of light-emitting diodes 106A-N. The refraction means 128 may be on each of the least one light-emitting diodes 106A-N. The refraction means 128 may bend the light from each of the least one light-emitting diode 106A-N to a center region 218 (not shown) of a surface of the bucket 102 and/or a focus of the interior 1002 (not shown) while permitting the entirety of the bucket 102 to luminesce through the translucent material. The refraction means 128 may bend the light from the at least one light-emitting diode 106A-N in a downward fashion. Light from the light-emitting diodes 106A-B may be visible through the exterior wall 118 of the bucket 102. The light-emitting diodes 106A-B may have an off mode, a constant on mode, and a flashing mode.

The plurality of decorative openings 108 may be formed during the single mold process in which the translucent material is manipulated in the form of the bucket 102. The plurality of decorative openings 108 may restrict passage of a holiday item outside the bucket 102. The plurality of decorative openings 108 may permit the light to pass through to a region exterior to the bucket 102 which may cause silhouetting and may transform the light into a kaleidoscopic pattern around a child carrying the bucket 102 during a holiday. The treat carrier 100 may further comprise a solid decorative object 126 that is transposed on the exterior wall 118 of the bucket 102 in which may block the light from passing through the solid decorative object 126.

Figure 2:
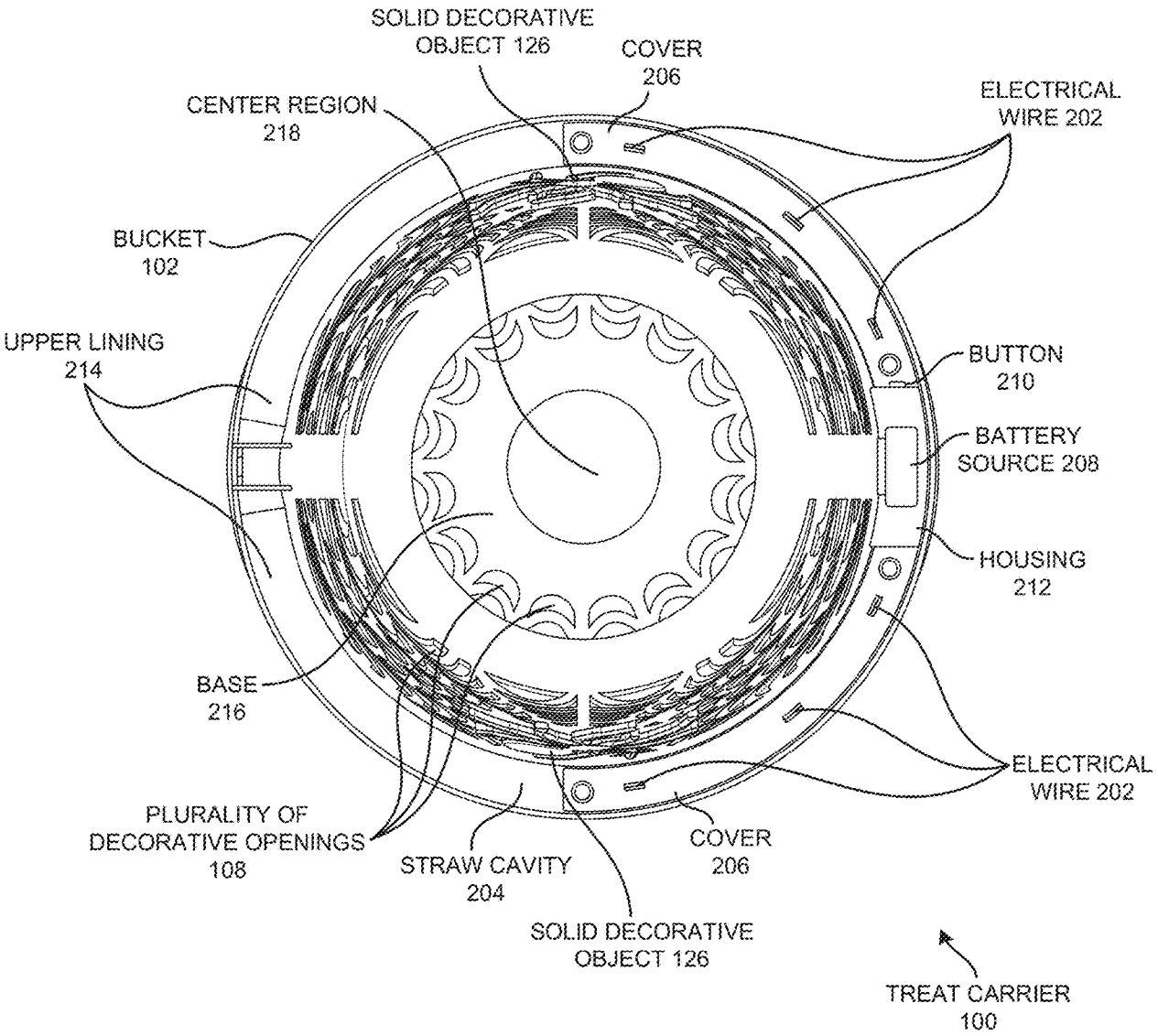
FIG. 2 is an upside down view of the underside components of the treat carrier of FIG. 1, according to one embodiment.

FIG. 2 is an upside down view of the underside components of the treat carrier of FIG. 1, according to one embodiment.

FIG. 2 illustrates the bucket 102, the plurality of decorative openings 108, the solid decorative object 126, a electrical wire 202, a straw cavity 204, a cover 206, a battery source 208, a button 210, a housing 212, a upper lining 214, a base 216, and a center region 218. The electrical wire 202 may be a single-core insulated wire, a multicore insulated wire, a jumper wire, a shielded wire, a twisted pair wire, a coaxial cable, a ribbon cable, and/or a hookup wire with alligator clips. The straw cavity 204 may be formed as a part of the single mold process and may be a cavity that is longer than it is wide and may be used to house cables, wires, cords, and/or other power transport devices. The straw cavity 204 may be on the underside of the upper rim 104. The cover 206 may be a part of the single mold process and may be a protective component made of a material similar to that of the bucket 102. The cover 206 may comprise a plurality of holes. The battery source 208 may be a alkaline battery, a lithium ion battery, a lithium polymer battery, a silver oxide battery, a zinc carbon battery, a zinc-air battery, and/or a button cell battery.

The button 210 may be a push-button switch, a slide switch, a toggle switch, a rocker switch, a dual in-line package switch, a tactile switch, a capacitive touch sensor, a proximity sensor, a rotary switch, and/or a soft power button. The housing 212 may be a battery case/holder, a battery compartment, a battery cover, a casing with integrated battery, a slide-out tray, a sealed enclosure, a battery pack, a battery door, a waterproof casing, and/or a soft enclosure. The upper lining 214 may be formed in the single mold process and may be the upper portion of the straw cavity 204 and may further be directly under the upper rim 104. The base 216 may be formed as part of the single mold process and may be the bottom portion of the bucket 102. The center region 218 may be a substantially center portion of the base 216 of the bucket 102.

As illustrated in FIG. 2, the treat carrier 100 may comprise the upper lining 214 which may be the underside of the upper rim 104. The treat carrier 100 further includes an electrical wire 202 that transposes within the straw cavity 204 of an upper lining 214 of the bucket 102. The treat carrier 100 further includes a battery source 208 that provides an electrical current that is carried through the electrical wire 202 to at least one light-emitting diode 106 affixed to the interior portion 120 of the top region 122 of the bucket 102. The upper lining 214 may comprise the straw cavity 204 in which the electrical wire 202 may be transposed. The straw cavity 204 may be enclosed by the cover 206 to protect the electrical wire 202 from damage from water, heat, and/or wear and tear. The cover 206 may be removably attached to the upper rim 104 and/or formed as part of the single mold process. The cover 206 may enclose all or part of the straw cavity 204. The battery source 208 may be attached to the upper lining 214 and/or the straw cavity 204 and may provide an electrical current that is carried through the electrical wire 202 to the light-emitting diodes 106A-B. The battery source 208 may be enclosed within a housing 212. One or more LEDs 106A-N may be enclosed within the housing 212 with the battery source 208. The housing 212 may provide support and/or protection to the battery source 208 and/or the encased LED 106A-B.

The button 210 may be adjacent to and/or embedded in the housing 212. The button 210 may toggle the light-emitting diodes 106A-B between an off mode, a constant on mode, and a flashing mode. The bucket 102 may further include the base 216 which may be formed as part of the single mold process and may be non-removably attached to the bucket 102. The base 216 may be substantially flat and may allow a user to set the treat carrier 100 on a surface without the treat carrier 100 tipping over. Within the base 216 is a center region 218 that may be of a different shape and/or texture than that of the entirety of the base 216.

Figure 3:
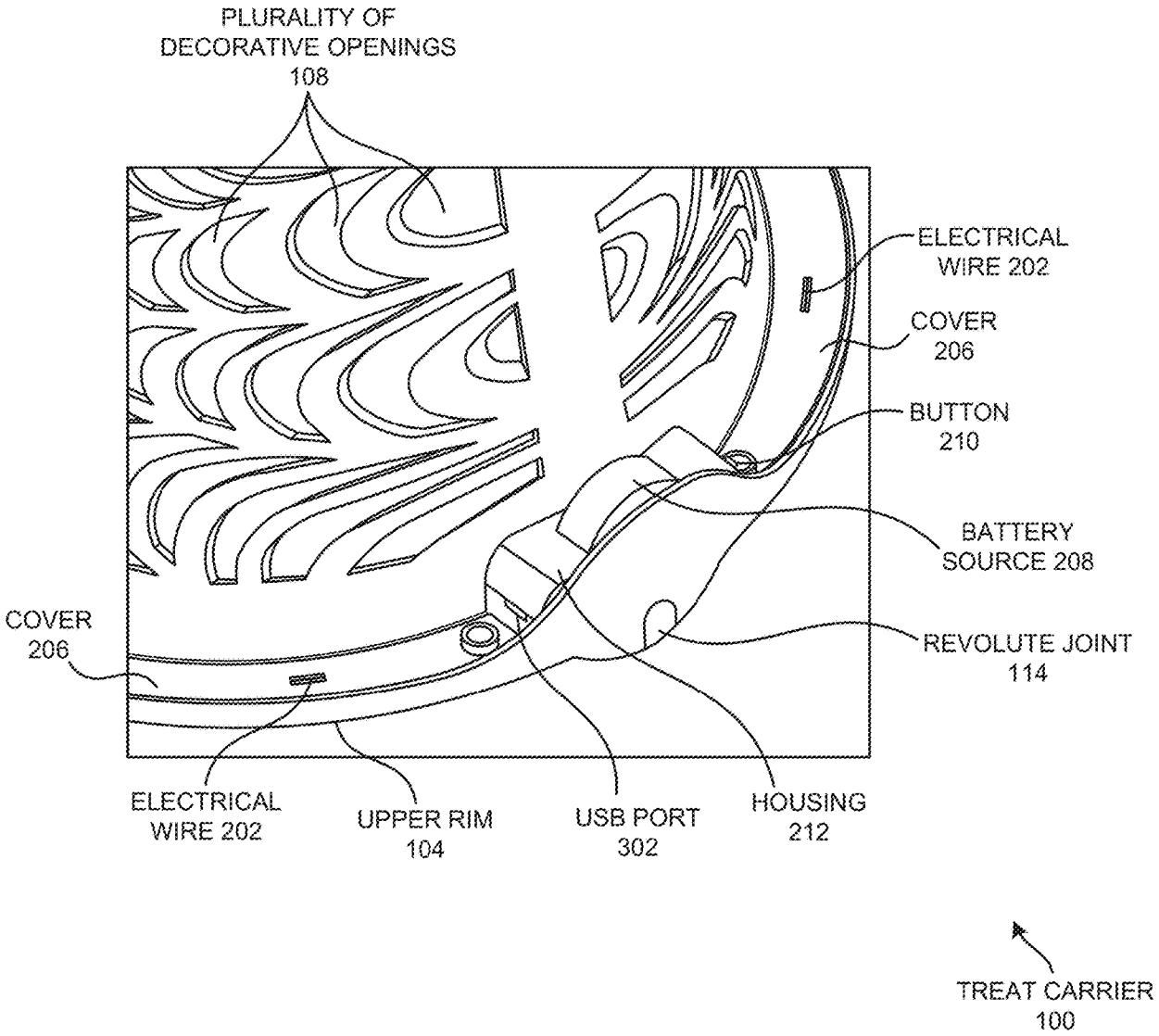
FIG. 3 is an upside down side view of the treat carrier of FIG. 1, according to one embodiment

FIG. 3 is an upside down, side view of the treat carrier of FIG. 1, according to one embodiment. FIG. 3 illustrates the upper rim 104, plurality of decorative openings 108, the revolute joint 114, the electrical wire 202, the cover 206, the battery source 208, the button 210, the housing 212, and a USB port 302.

The USB port 302 may be a power receiving charging port designed to receive a USB type-A, a USB type-B, a USB type-C, a USB micro-A, a USB micro-B, a USB mini-A, a USB mini-B, a USB 3.0 micro-B, and/or a USB 3.1 gen 2 type-C. The USB port may be adjacent to or embedded in the housing 212 and may be used to charge and/or program the battery source 208.

According to one or more embodiments illustrated in FIG. 3, the battery source 208 is enclosed within the housing 212. One or more LEDs 106A-N may also be enclosed with the battery source 208 within the housing 212. The button 210 may be adjacent to or embedded in the housing 212. The button 210 may toggle the light-emitting diodes 106A-B between the off mode, the constant on mode, and a flashing mode. The USB port 302 may be adjacent to or embedded in the housing 212 and may be used to charge and/or program the battery source 208. The electrical wire 202 may be connected to the battery source 208 and may be used to transport power to the LEDs 106A-N. The electrical wire 202 may transpose within the straw cavity 204 of the upper lining 214 of the bucket 102. The battery source 208 may provide an electrical current that is carried through the electrical wire 202 to the light-emitting diodes 106A-B affixed to the interior portion 120 of the top region 122 of the bucket 102.

Figure 4:
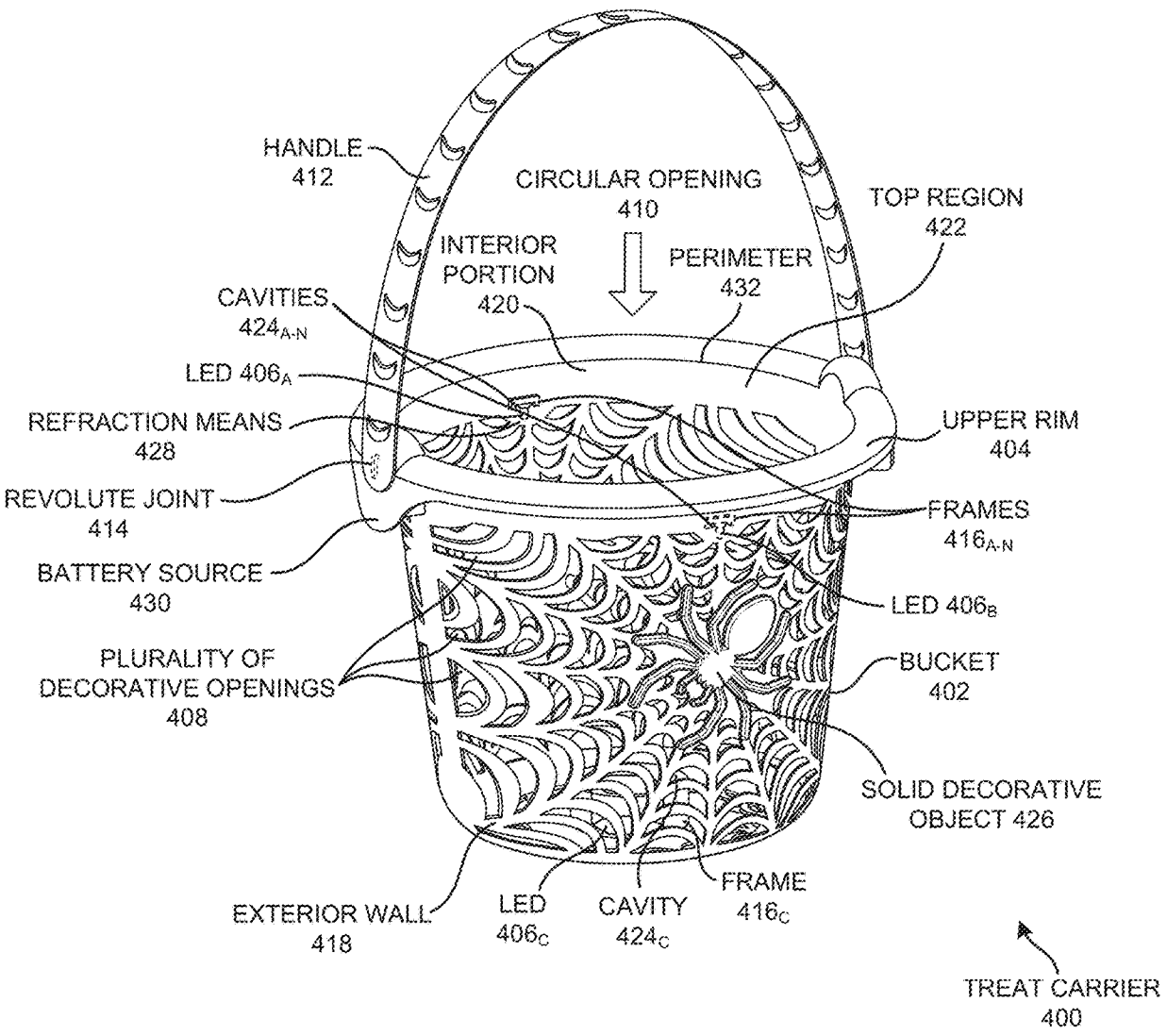
FIG. 4 is a side view of a second embodiment of a treat carrier comprising a third LED, a second wire, and a second cover, according to one embodiment.

FIG. 4 is a side view of a second embodiment of a treat carrier 400 comprising a third LED light 406C, according to one embodiment.

FIG. 4 illustrates a treat carrier 400 comprising a bucket 402, a upper rim 404, a first light-emitting diode 406A, a second light-emitting diode 406B, a third light-emitting diode 406C, a plurality of decorative openings 408, a circular opening 410, a handle 412, a revolute joint 414, a first frame 416A, a second frame 416B, a third frame 416C, an exterior wall 418, an interior portion 420, a top region 422, a first cavity 424A, a second cavity 424B, a third cavity 424C, a solid decorative object 426, a refraction means 428, a battery source 430, and a perimeter 432.

The bucket 402 may be formed from a single mold process and may be of a translucent material such as translucent, translucent Terephthalate (PET), Polypropylene (PP), Polycarbonate (PC), Polyvinyl Chloride (PVC), Silicone, Resins, translucent (PE), and/or Thermoplastic Polyurethane (TPU). The upper rim 404 may be formed of a translucent single mold translucent material and may be curved and/or flat in shape. The light-emitting diodes (e.g. a LED) 406A-C may be through-hole LEDs, surface mount device (SMD) LEDs, high-power LEDs, RGB LEDs, ultraviolet LEDs, organic LEDs, chip-on-board LEDs filament LEDs, LED strips, miniature LEDs, and/or ceramic LEDs.

The plurality of decorative openings 408 may be formed in the single mold process and may be many different types of holiday-themed orientations including moons, spiders, ghosts, ghouls, stars, bunnies, and/or religious insignia. The circular opening 410 may be the top aperture through which users place holiday items. The handle 412 may be formed of plastic, wire, metal, leather, and/or rope. The revolute joint 414 may be a hinge joint, a fixed revolute joint, a pin joint, a cylindrical joint, a swing arm joint, a spherical joint (e.g. a ball joint), a wrist joint, and/or a finger joint. The first, second, and third frames 416A-C may be formed in the single mold process or as an attachment and may be formed of different plastic materials. Furthermore the frames 416A-C may be light fixtures, light panels, light boxes, LED strip profiles, recessed lighting trims, and/or LED channel letters.

The exterior wall 418 may be formed of the single mold process and may comprise any portion of the outer area of the bucket 402. The interior portion 420 may be formed in the single mold process and may comprise any portion of the inner area of the bucket 402. The top region 422 may be formed in the single mold process and may comprise any of the top third of the bucket 402. The cavities 424A-C may be formed in the single mold process and may comprise electrical components and/or structural components. The solid decorative object 426 may be formed in the single mold process and/or added to the bucket via a screw, adhesive, and/or melt bonding. The refraction means 428 may be one or more lenses, reflectors, fresnel lenses, total internal reflection optics, diffusers, prismatic lenses, barn doors/light louvers, diffusion plates, lenticular sheets, and/or prism films. The battery source 430 may be a alkaline battery, a lithium ion battery, a lithium polymer battery, a silver oxide battery, a zinc carbon battery, a zinc-air battery, and/or a button cell battery. The perimeter 432 may be the partial or whole circumference of any point of the treat carrier 400.

According to one embodiment of FIG. 4, the treat carrier 400 may comprise the bucket 402 which may further comprise the plurality of decorative openings 408 wherein the openings do not allow a holiday item to pass through. The bucket 402 may be primarily formed through a single mold process in which a translucent material is manipulated in a form of the bucket 402. The bucket 402 may further comprise the upper rim 404 which may be formed around the perimeter 432 of the circular opening 410 of the bucket 402.

The bucket 402 may further comprise the first and second cavities 424A-B which may be oppositely formed in an interior portion 420 of the top region 422 of the circular opening 410 of the bucket 402. The cavities 424A-B may bisect a sectional plane of a circular opening 410 of the bucket 402 and may be approximately 1 pi radians apart from each other. The bucket 402 may further comprise the third cavity 424C which may be formed at the bottom of the bucket 402. The first LED 406A may be directly embedded within the first cavity 424A. The second LED 406B may be directly embedded within the second cavity 424B. The third LED 406C may be directly embedded within the third cavity 424C.

The cavities 424A-C may be formed to receive the first, second, and third frames 416A-C respectively. The first frame 416A, the second frame 416B, and the third frame 416C may be formed to fit into the first cavity 424A, the second cavity 424B, and the third cavity 424C respectively. The frames 416A-C may encase the light-emitting diodes 406A-C and may be formed to provide protection and support to the light-emitting diodes 406A-C. The first frame 416A may fully or partially encase the first light-emitting diode 406A. The second frame 416B may fully or partially encase the second light-emitting diode 406B. The third frame 416C may fully or partially encase the third light-emitting diode 406C.

Although only one refraction means 428 is illustrated, the refraction means 428 may be attached to any number of light-emitting diodes 406A-N. The refraction means 428 may be attached to each of the light-emitting diodes 406A-C. The refraction means 428 may bend the light from each of the light-emitting diodes 406A-C to a center region 504 (not shown) of the bucket 402 and/or a focus of the interior 1002 (not shown) while permitting the entirety of the bucket 402 to luminesce through the translucent material. Light from the light-emitting diodes 406A-C may be visible through the exterior wall 418 of the bucket 402. The light-emitting diodes 406A-C may have an off mode, a constant on mode, and/or a flashing mode.

The plurality of decorative openings 408 may be formed during the single mold process in which the translucent material is manipulated in the form of the bucket 402. The plurality of decorative openings 408 may restrict passage of a holiday item outside the bucket 402. The plurality of decorative openings 408 along a surface of an exterior wall may permit the light to pass through to a region exterior to the bucket 402 which may cause silhouetting and may transform the light into a kaleidoscopic pattern around a child carrying the bucket 402 during a holiday. The bucket 402 may further comprise a solid decorative object 426 that is transposed on the exterior wall 418 that blocks the light from passing through the solid decorative object 426. The embodiment may further include a handle 412 that is attached to one of the bucket 402, the top region 422 of the circular opening 410 of the bucket 402, and/or the upper rim 404. The handle 412 may be attached via a revolute joint 414, which may allow the handle to swivel in a rotational manner. The battery source 430 may be affixed to the bucket 402 near the top region and/or the upper rim 404.

Figure 5:
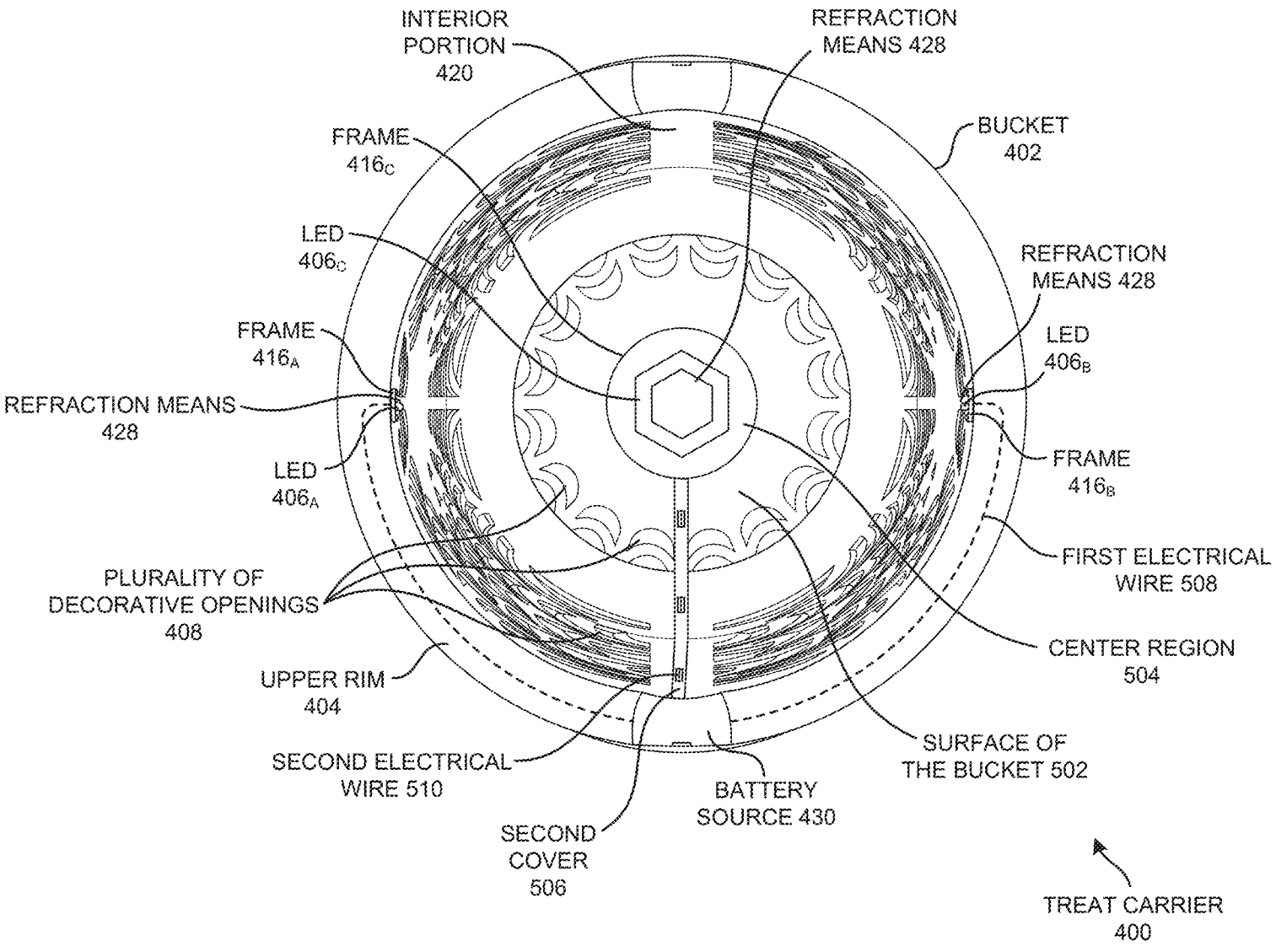
FIG. 5 is a top view of the treat carrier of FIG. 4, according to one embodiment.

FIG. 5 is a top view of the treat carrier 400 of FIG. 4 through the circular opening 410, according to one embodiment.

FIG. 5 illustrates the bucket 402, the upper rim 404, the LEDs 406A-C, the plurality of decorative openings 408, the frames 416A-C, the interior portion 420, the refraction means 428, the battery source 430, a surface of the bucket 502, a center region 504, a second cover 506, a first electrical wire 508, and a second electrical wire 510.

The surface of the bucket 502 may be formed as part of the single mold process and may be the same material as the bucket 402. The center region 504 may be formed as part of the single mold process and may be the same material as the bucket 402. The second cover 506 may be formed as part of the single mold process and may be the same material as the bucket 402 and/or may be a separate piece and may be attached to the bucket 402 after the single mold process. The first electrical 508 wire may be a single-core insulated wire, a multicore insulated wire, a jumper wire, a shielded wire, a twisted pair wire, a coaxial cable, a ribbon cable, and/or a hookup wire with alligator clips. The second electrical wire 510 may be a single-core insulated wire, a multicore insulated wire, a jumper wire, a shielded wire, a twisted pair wire, a coaxial cable, a ribbon cable, and/or a hookup wire with alligator clips.

As illustrated in FIG. 5, the first electrical wire 508 runs below the upper rim 404. The second electrical wire 510 may be transposed on the inner portion 420 and enclosed by a second cover 506. The second cover 506 may be transposed on the interior portion 420 of the bucket 402. The second cover 506 may encase and protect the second electrical wire 510 from water, heat, and/or wear and tear. The battery source 430 may carry power to the first electrical wire 508 and the second electrical wire 510. The first electrical wire 508 may carry power from the battery source 430 to the first LED 406A. Furthermore, the first electrical wire 508 may carry power from the battery source 430 to the second LED 406B. The second electrical wire 510 may run along the interior wall 420 of the bucket 402 and may carry power from the battery source 430 to the third LED 406C.

The surface of the bucket 402 may comprise a plurality of decorative openings 408 which may be formed during the single mold process in which translucent material may be manipulated in the form of the bucket 402 to restrict passage of a holiday item outside the bucket 402. The plurality of decorative openings 408 may permit light from the LEDs 406A-N to pass through to a region exterior to the bucket 402. The surface of the bucket 502 may allow candy and/or other holiday items to pile within the bucket 402 while upkeeping the structural integrity of the treat carrier 400. The center region 504 may be the center portion of the surface of the bucket 502 and may be the region where the third LED 406C, the third frame 416C, and the refraction means 428 are placed.

Figure 6:
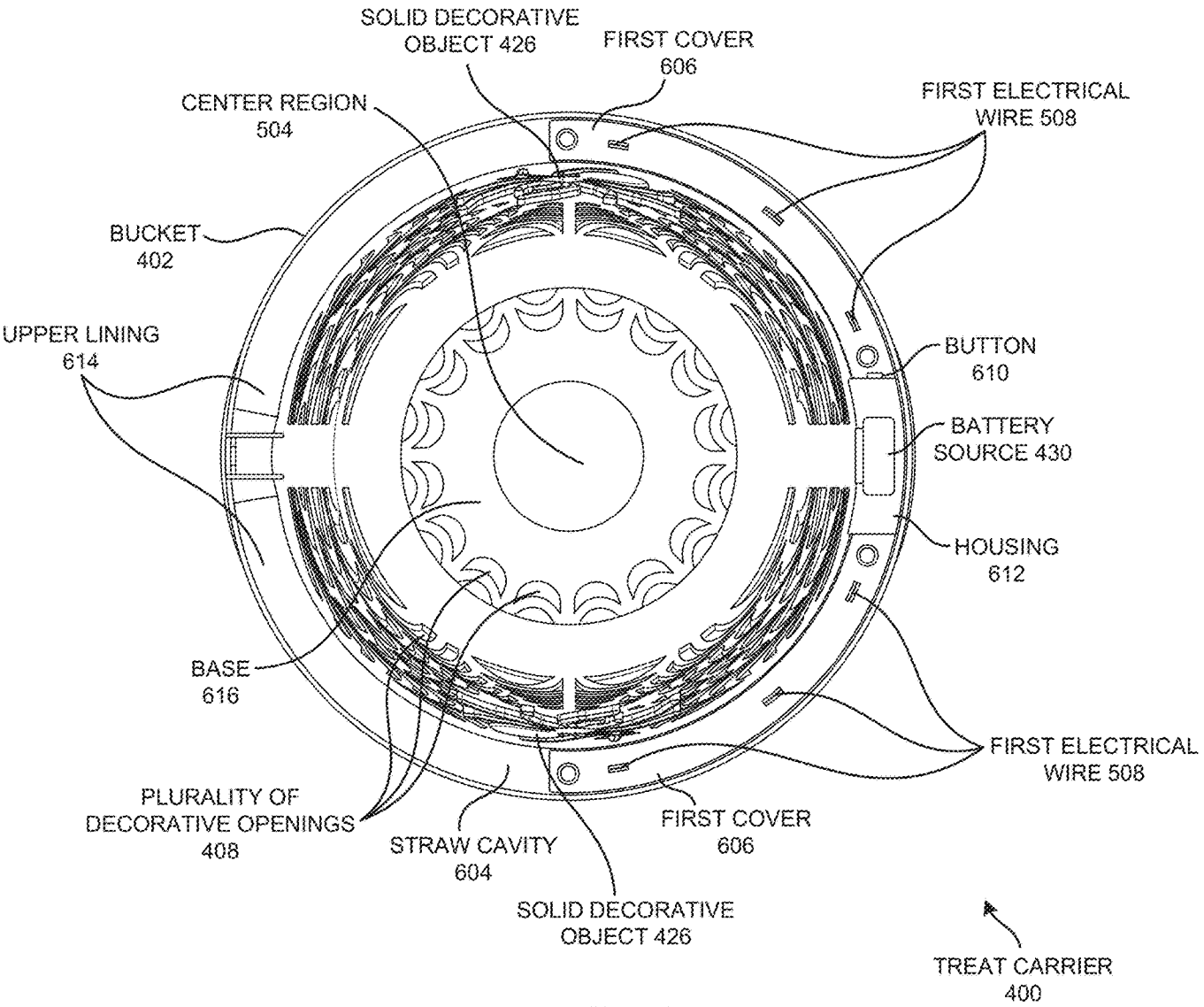
FIG. 6 is an upside down view of the underside components of the treat carrier of FIG. 4, according to one embodiment.

FIG. 6 is an upside down view of the underside components of the treat carrier of FIG. 4, according to one embodiment.

FIG. 6 illustrates the bucket 402, the plurality of decorative openings 408, the solid decorative object 426, a battery source 430, a center region 504, a first electrical wire 508, a straw cavity 604, a first cover 606, a button 610, a housing 612, a upper lining 614, and a base 616. The straw cavity 604 may be formed as a part of the single mold process and may be a cavity that is longer than it is wide and may be used to house cables, wires, cords, and/or other power transport devices. The straw cavity 604 may be on the underside of the upper rim 404. The first cover 606 may be a part of the single mold process and/or a separate piece attached to the bucket 402. The first cover 606 may be a protective component made of a material similar to that of the bucket 402. The first cover 606 may comprise a plurality of holes. The first cover 606 may be formed of a translucent single mold translucent material. The button 610 may be a push-button switch, a slide switch, a toggle switch, a rocker switch, a dual in-line package switch, a tactile switch, a capacitive touch sensor, a proximity sensor, a rotary switch, and/or a soft power button. The housing 612 may be a battery case/holder, a battery compartment, a battery cover, a casing with integrated battery, a slide-out tray, a sealed enclosure, a battery pack, a battery door, a waterproof casing, and/or a soft enclosure. The upper lining 614 may be formed in the single mold process and may be the upper portion of the straw cavity 604 and may further be directly under the upper rim 404. The base 616 may be formed as part of the single mold process and may be the bottom portion of the bucket 402.

According to one or more embodiments illustrated in FIG. 6, the first electrical wire 508 may be transposed within a straw cavity 604 of an upper lining 614 of the bucket 402. The straw cavity 604 may be below the upper rim 404 and the first electrical wire 508 may be affixed within the straw cavity 604 across the perimeter 432 of the circular opening 410 of the bucket 402. The straw cavity 604 may be enclosed by the first cover 606 to protect the first electrical wire 508 from damage such as water, heat, and/or wear and tear. The first cover 606 may be removably attached to the upper rim 404 and/or formed as the single mold process. The first cover 606 may enclose all or part of the straw cavity 604. The first cover 606 may be made of a material that is the same or similar to that of the bucket 102 and may comprise a plurality of holes. The battery source 430 may be attached to the upper lining 614 and/or the straw cavity 604. The battery source 430 may provide an electrical current that is carried through the first electrical wire 508 to the light-emitting diodes 406. The battery source 430 may be encased within a housing 612. Any one of the light-emitting diodes 406 may be encased with the battery source 430 within a housing 612. The housing 612 may protect the battery source 430 and/or the encased LEDs 406 from water, heat, and/or wear and tear.

The button 610 may be adjacent to and/or embedded within the housing 612 and may communicate with the battery source 430. The button 610 may toggle the light-emitting diodes 406 between an off mode, a constant on mode, and a flashing mode. The bucket 402 further includes the base 616 which may be formed of the same material as the bucket 402 and may be formed as part of the single mold process. The base 616 may be substantially flat and may allow a user to set the treat carrier 400 on a surface without the treat carrier tipping over. Within the base 616 is a center region 504 that may be of a different shape and/or texture than that of the entirety of the base 616.

Figure 7:
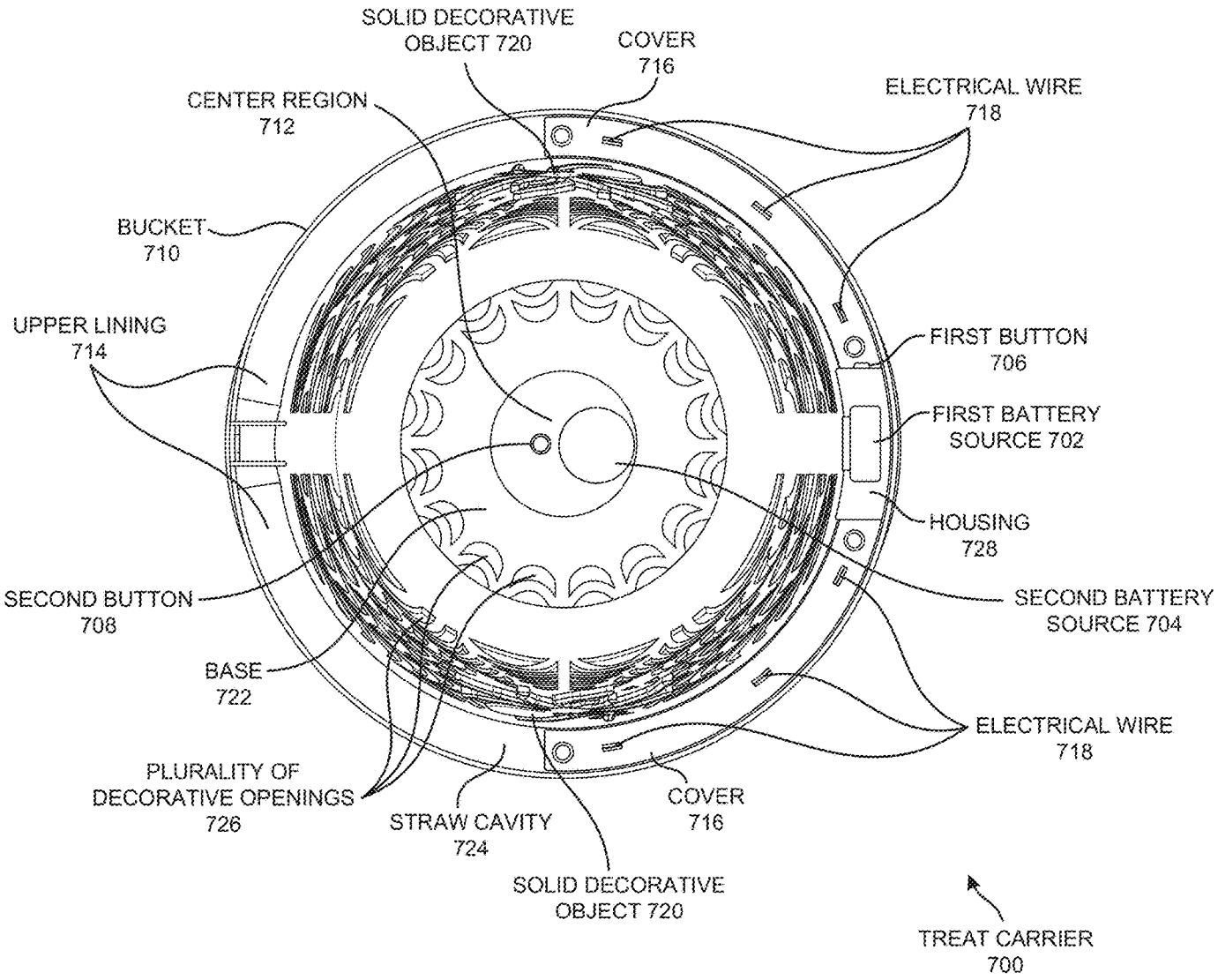
FIG. 7 is a upside down view of a third embodiment of a treat carrier comprising a third LED, a second battery source, and a second button according to one embodiment.

FIG. 7 is a upside down view of a third embodiment of a treat carrier 700 comprising a third LED 804C, a second battery source 708, and a second button 708, according to one embodiment.

FIG. 7 illustrates a first battery source 702, a second battery source 704, a first button 706, a second button 708, a bucket 710, a center region 712, a upper lining 714, a cover 716, a electrical wire 718, a solid decorative object 720, a base 722, a straw cavity 724, and a plurality of decorative openings 726. The first battery source 702 may be a alkaline battery, a lithium ion battery, a lithium polymer battery, a silver oxide battery, a zinc carbon battery, a zinc-air battery, and/or a button cell battery. The second battery source 704 may be a alkaline battery, a lithium ion battery, a lithium polymer battery, a silver oxide battery, a zinc carbon battery, a zinc-air battery, and/or a button cell battery. The first button 706 may be a push-button switch, a slide switch, a toggle switch, a rocker switch, a dual in-line package switch, a tactile switch, a capacitive touch sensor, a proximity sensor, a rotary switch, and/or a soft power button. The second button 708 may be a push-button switch, a slide switch, a toggle switch, a rocker switch, a dual in-line package switch, a tactile switch, a capacitive touch sensor, a proximity sensor, a rotary switch, and/or a soft power button.

The bucket 710 may be formed from a single mold process and may be of a translucent material such as translucent, translucent Terephthalate (PET), Polypropylene (PP), Polycarbonate (PC), Polyvinyl Chloride (PVC), Silicone, Resins, translucent (PE), and/or Thermoplastic Polyurethane (TPU). The center region 712 may be the substantially center portion of the base 722 of the bucket 710. The upper lining 714 may be formed in the single mold process and may be the upper portion of the straw cavity 724 and may further be directly under the upper rim 808. The cover 716 may be a part of the single mold process and may be a protective component made of a material similar to that of the bucket 710.

The electrical wire 718 may be a single-core insulated wire, a multicore insulated wire, a jumper wire, a shielded wire, a twisted pair wire, a coaxial cable, a ribbon cable, and/or a hookup wire with alligator clips. The solid decorative object 720 may be formed in the single mold process and/or added to the bucket via a screw, adhesive, and/or melt bonding. The base 722 may be formed as part of the single mold process and may be the bottom portion of the bucket 710. The straw cavity 724 may be formed as a part of the single mold process and may be a cavity that is longer than it is wide and may be used to house cables, wires, cords, and/or other power transport devices. The plurality of decorative openings 726 may be formed in the single mold process and may be many different types of holiday-themed orientations including moons, spiders, ghosts, ghouls, stars, bunnies, and/or religious insignia.

As illustrated in FIG. 7, the treat carrier 700 may comprise the upper lining 714 which may be the underside of the upper rim 808 (not shown). The upper lining 714 may comprise the straw cavity 724 in which the electrical wire 718 may be transposed. The straw cavity 724 may be enclosed by the cover 716 to protect the electrical wire 718 from damage from water, heat, and/or wear and tear. The cover 716 may be removably attached to the upper rim 808 and/or formed as part of the single mold process. The cover 716 may enclose all or part of the straw cavity 714. The first battery source 702 may be attached to the upper lining 714 and/or the straw cavity 724 and may provide an electrical current that is carried through the electrical wire 718 to light-emitting diodes 804A-B (not shown). The first battery source 702 may be enclosed within a housing 728. One or more LEDs 804A-N may also be enclosed within the housing 728 with the first battery source 702. The housing 728 may provide support and/or protection to the first battery source 702 and/or the encased LED 804A-N. The first button 706 may be adjacent to and/or embedded in the housing 728. The first button 706 may toggle the first and second light-emitting diodes 804A-B between an off mode, a constant on mode, and a flashing mode. The treat carrier 700 may further include a plurality of decorative openings 726. The plurality of decorative openings 726 may restrict passage of a holiday item outside the bucket 710. The plurality of decorative openings 726 along a surface of an exterior wall may permit the light to pass through to a region exterior to the bucket 710 which may cause silhouetting and may transform the light into a kaleidoscopic pattern around a child carrying the bucket 710 during a holiday. The treat carrier 700 may further comprise a solid decorative object 720 that is transposed on the exterior wall of the bucket 710 in which may block the light from passing through the solid decorative object 126.

The bucket 710 may further include the base 722 which may be formed as part of the single mold process and may be non-removably attached to the bucket. The base 722 may be substantially flat and may allow a user to set the treat carrier 700 on a surface without the treat carrier tipping over. Within the base 722 may be center region 712 that may be of a different shape and/or texture than that of the entirety of the base 722. The second button 708, the second battery source 704, and the third LED 804C (not shown) may be located at the center region 712 of the bucket 710. The third light-emitting diode 804C may be powered by the second battery source 702 which may be located at the center region 712 of the bucket 710. The second button 708 may toggle the third light-emitting diode 804C between an off mode, a constant on mode, and/or a flashing mode. The second button 708 may be located on the underside of base 722 at the center region 712 of the bucket 710. The second button 708 and the second battery source 702 may be housed together.

Figure 8:
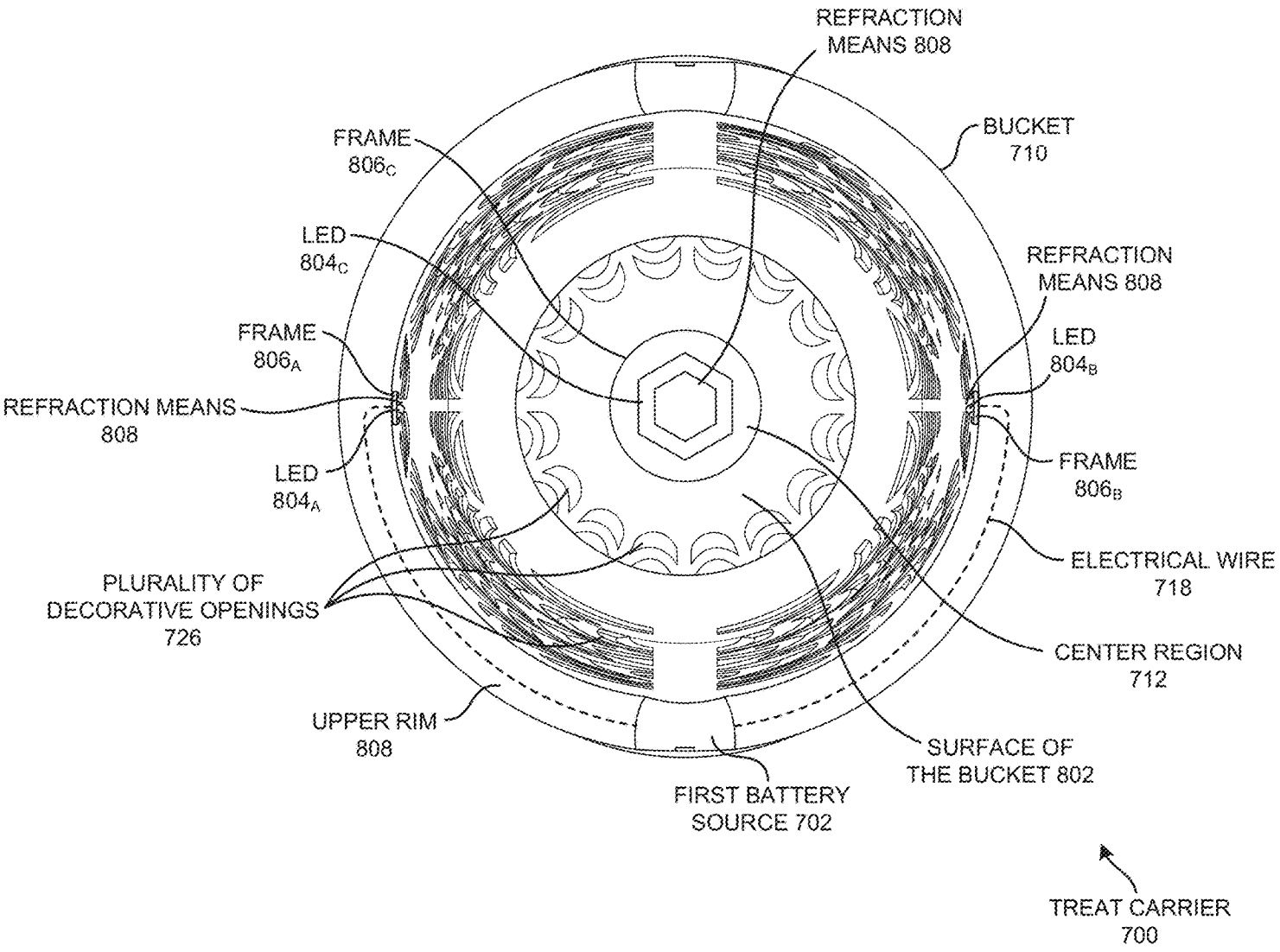
FIG. 8 is a top view of the treat carrier of FIG. 7, according to one embodiment.

FIG. 8 is a top view of the treat carrier 700 of FIG. 7, according to one embodiment. FIG. 8 illustrates the first battery source 702, the bucket 710, the center region 712, the electrical wire 718, the plurality of decorative openings 726, a surface of the bucket 802, a plurality of LEDs 804A-N, a plurality of frames 806A-N, a upper rim 808, and a refraction means 810.

The surface of the bucket 802 may be formed as part of the single mold process and may be the same material as the bucket 710. The plurality of LEDs 804A-N may be through-hole LEDs, surface mount device (SMD) LEDs, high-power LEDs, RGB LEDs, ultraviolet LEDs, organic LEDs, chip-on-board LEDs filament LEDs, LED strips, miniature LEDs, and/or ceramic LEDs. The plurality of frames 806A-N may be formed in the single mold process or as an attachment and may be formed of different plastic materials. Furthermore the frames 806A-N may be light fixtures, light panels, light boxes, LED strip profiles, recessed lighting trims, and/or LED channel letters. The upper rim 808 may be created as part of the single mold process and may be curved and/or flat. The refraction means 810 may be one or more lenses, reflectors, fresnel lenses, total internal reflection optics, diffusers, prismatic lenses, barn doors/light louvers, diffusion plates, lenticular sheets, and/or prism films.

As illustrated in FIG. 8, the electrical wire 718 may run below the upper rim 808. The battery source 702 may carry power to the electrical wire 718. The electrical wire 718 may carry power from the battery source 702 to the first LED 804A. Furthermore, the electrical wire 718 may carry power from the battery source 702 to the second LED 804B. The light-emitting diodes 804A-B may have an off mode, a constant on mode, and a flashing mode. The first button 706 may toggle the LEDs 804A-B between the off mode, the constant on mode, and the flashing mode.

The third light-emitting diode 804C may be located at the center region 712 of the surface of the bucket 802. The third light-emitting diode 804C may be powered by a second battery source 704. The second battery source may be located at the center region 712 of the bucket. The second button 708 may also be located at the center region 712 of the bucket 710. The second button 708 may toggle the third light-emitting diode 804C between an off mode, a constant on mode, and a flashing mode.

The refraction means 808 may attached to the LEDs 804A-C and may bend the light from each of the light-emitting diodes 804A-C to a center region 712 of the surface of the bucket 802 and/or a focus of the interior 1002 (not shown) while permitting the entirety of the bucket 710 to luminesce through the translucent material. Light from the light-emitting diodes 804A-C may be visible through the exterior wall of the bucket 710.

Figure 9:
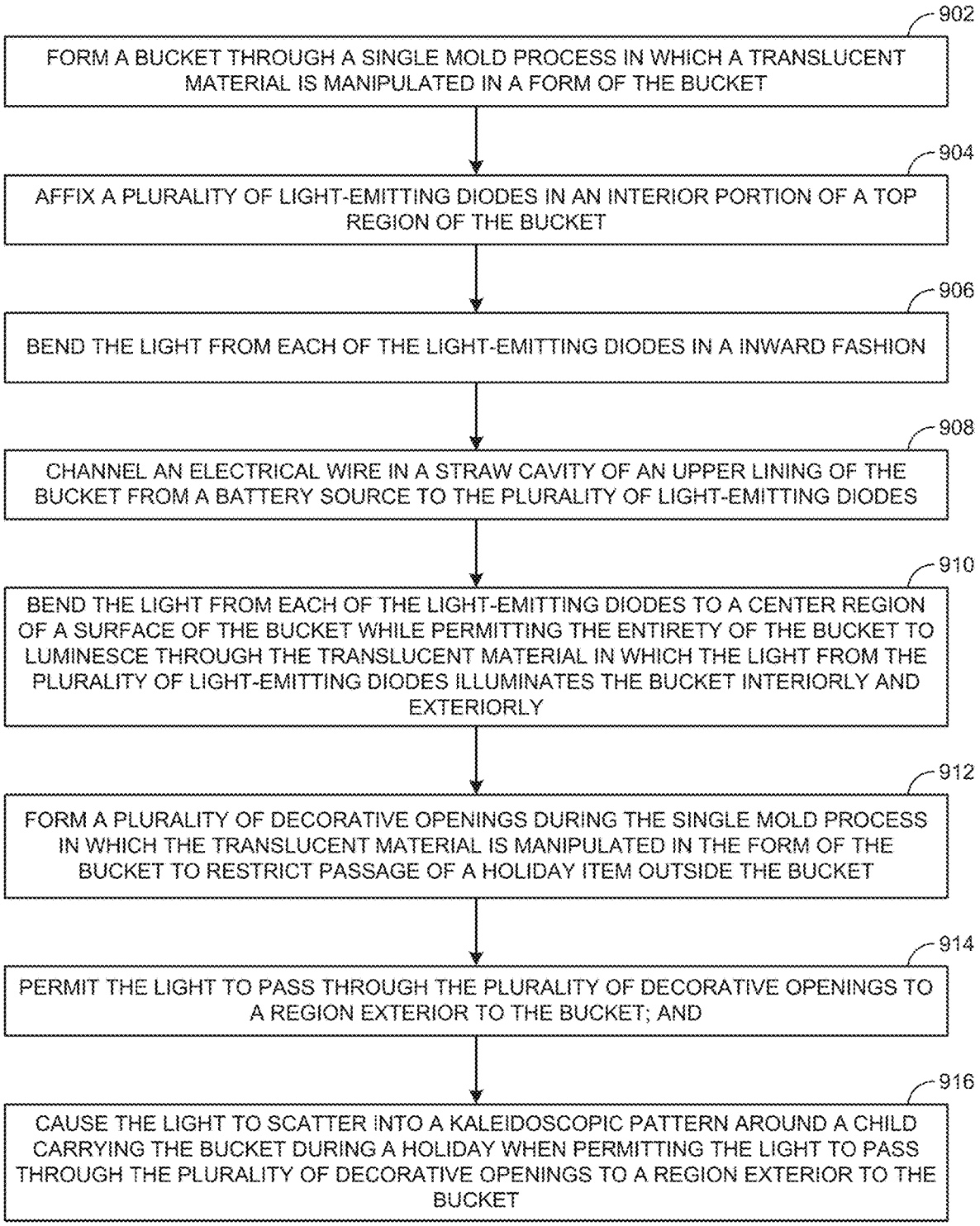
FIG. 9 is a process flow diagram describing a method of manufacturing the treat carrier of FIG. 1, FIG. 4, and FIG. 7, according to one embodiment.

FIG. 9 is a process flow diagram describing a method of manufacturing the treat carrier of FIG. 1, FIG. 5, and FIG. 7, according to one embodiment. In operation 902, a bucket may be formed through a single mold process in which a translucent material is manipulated in a form of the bucket. In operation 904, a plurality of light-emitting diodes may be affixed in an interior portion of a top region of the bucket. In operation 906, the light from each of the light-emitting diodes may be bent in an inward fashion. In operation 908, an electrical wire may be channeled in a straw cavity of an upper lining of the bucket from a battery source to the plurality of light-emitting diodes. In operation 910, the light from each of the light-emitting diodes may be bent to a center region of a surface of the bucket while permitting the entirety of the bucket to luminesce through the translucent material in which the light from the plurality of light-emitting diodes illuminates the bucket interiorly and exteriorly (e.g., whose light emanates through the exterior wall of the bucket). In operation 912, a plurality of decorative openings may be formed during the single mold process in which the translucent material is manipulated in the form of the bucket to restrict passage of a holiday item outside the bucket. In operation 914, the light may be permitted to pass through the plurality of decorative openings to a region exterior to the bucket. In operation 916, the light may be caused to scatter into a kaleidoscopic pattern around a child carrying the bucket during a holiday when permitting the light to pass through the plurality of decorative openings to a region exterior to the bucket.

Figure 10:
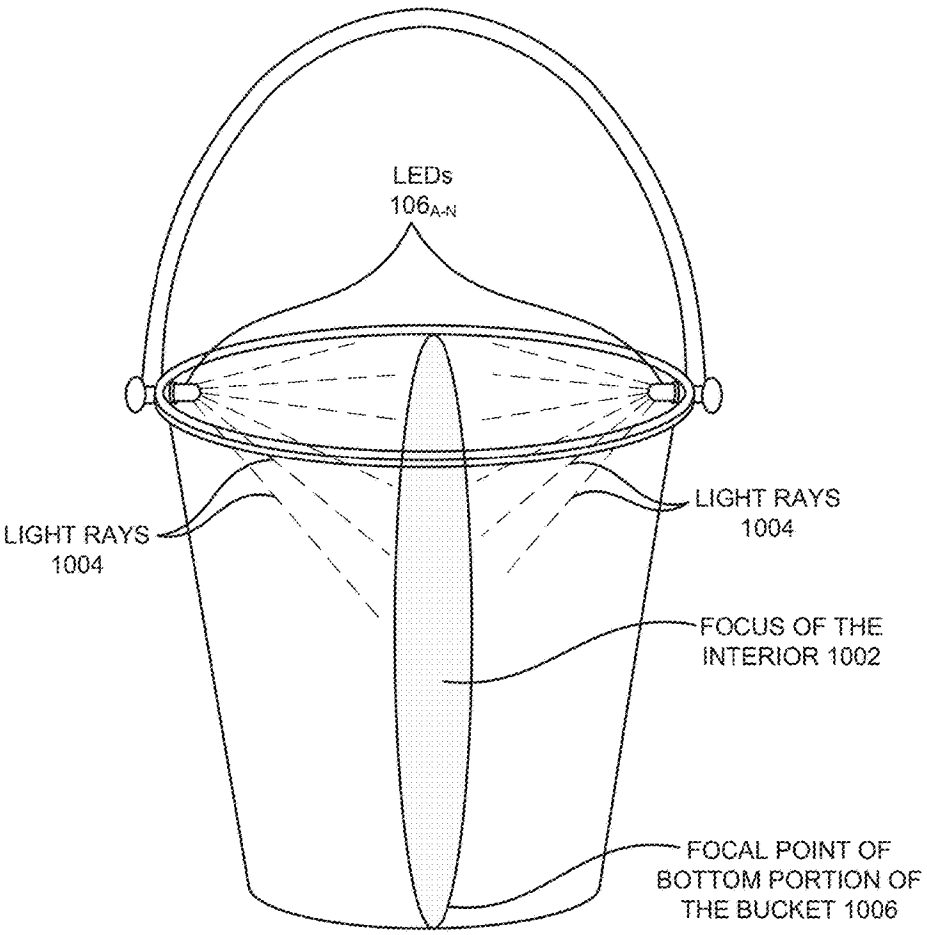
FIG. 10 is a side view of the embodiments of FIG. 1, FIG. 4, and FIG. 7 in which a focus of the interior of the bucket is shown, according to one embodiment.

FIG. 10 is a side view of the embodiments of FIG. 1, FIG. 4, and FIG. 7 illustrating a focus of the interior of the bucket 1002, according to one embodiment. FIG. 10 shows LEDs 106A-N, a focus of the interior 1002, light rays 1004, and a focal point of the bottom portion of the bucket 1006. The focus of the interior 1002 may be the point at which the 1004 light rays converge or from which they appear to diverge after passing through the refraction means 128. Furthermore, the focus of the interior 1002 may be a focal line of a focal plane in the direct center of the bucket 102 which may extend up from the bottom of the bucket through the circular opening 110. Light rays 1004 may be light from the LEDs 106 which may be refracted via the refraction means 128. The focal point of the bottom portion of the bucket 1006 may be the exact center of the bottom of the bucket 102 wherein the focus of the interior 1002 emanates from.

As illustrated in FIG. 10, the LEDs 106 and the refraction means 128 may be oriented to focus the light rays 1004 toward a focus of the interior 1002 which may extend from the focal point of the bottom portion of the bucket 1006. The LEDs 106 and the refraction means 128 may be oriented to project light rays 1004 to any portion of the focus of the interior 1002 (e.g. in a downward, inward, and/or upward direction).

Figure 11:
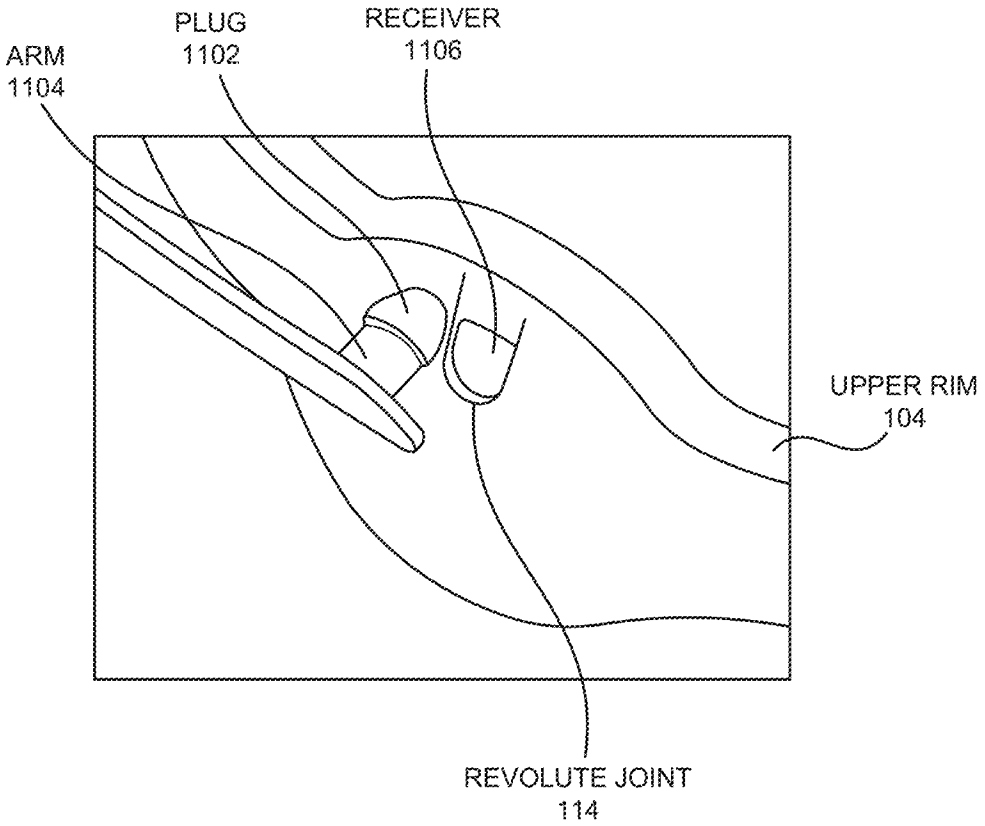
FIG. 11 is an exploded view of the revolute joint of the embodiments of FIG. 1, FIG. 4, and FIG. 7, according to one embodiment.

FIG. 11 is an exploded view of the revolute joint of the embodiments of FIG. 1, FIG. 4, and FIG. 7, according to one embodiment. FIG. 11 shows the upper rim 104 and the revolute joint 114 of the treat carrier 100 comprising a plug 1102, a arm 1104, and a receiver 1106. The plug 1104 may be a semi conical component made of plastic which fits into the receiver 1106 in order to attach the handle 112 to one of the bucket 102, the top region 122 of the circular opening 110 of the bucket 102, and/or the upper rim 104. The arm 1104 may be a plastic connecting piece that connects the plug 1102 to the handle 112. The arm 1104 may be the axis of rotation for the revolute joint 114 and may occupy the receiver 1106. The receiver 1106 may be an opening in one of the bucket 102, the top region 122 of the circular opening 110 of the bucket, and/or the upper rim 104. The receiver 1106 may be where the plug 1102 is inserted and may be where the arm 1104 rests. In one or more embodiments, the receiver 1106 is smaller than the plug 1102 when the plug 1102 is in an uncompressed orientation. When the plug 1102 is compressed, it may then be smaller than the receiver 1106 and may be inserted into the receiver 1106. After inserting the plug 1102 into the receiver 1106, the plug 1102 may be uncompressed and subsequently become larger than the receiver 1106, thus locking the arm 1104 into the receiver 1106, which may ensure the handle 112 is attached to the bucket 102 and may rotate in a revolute manner.

Figure 12:
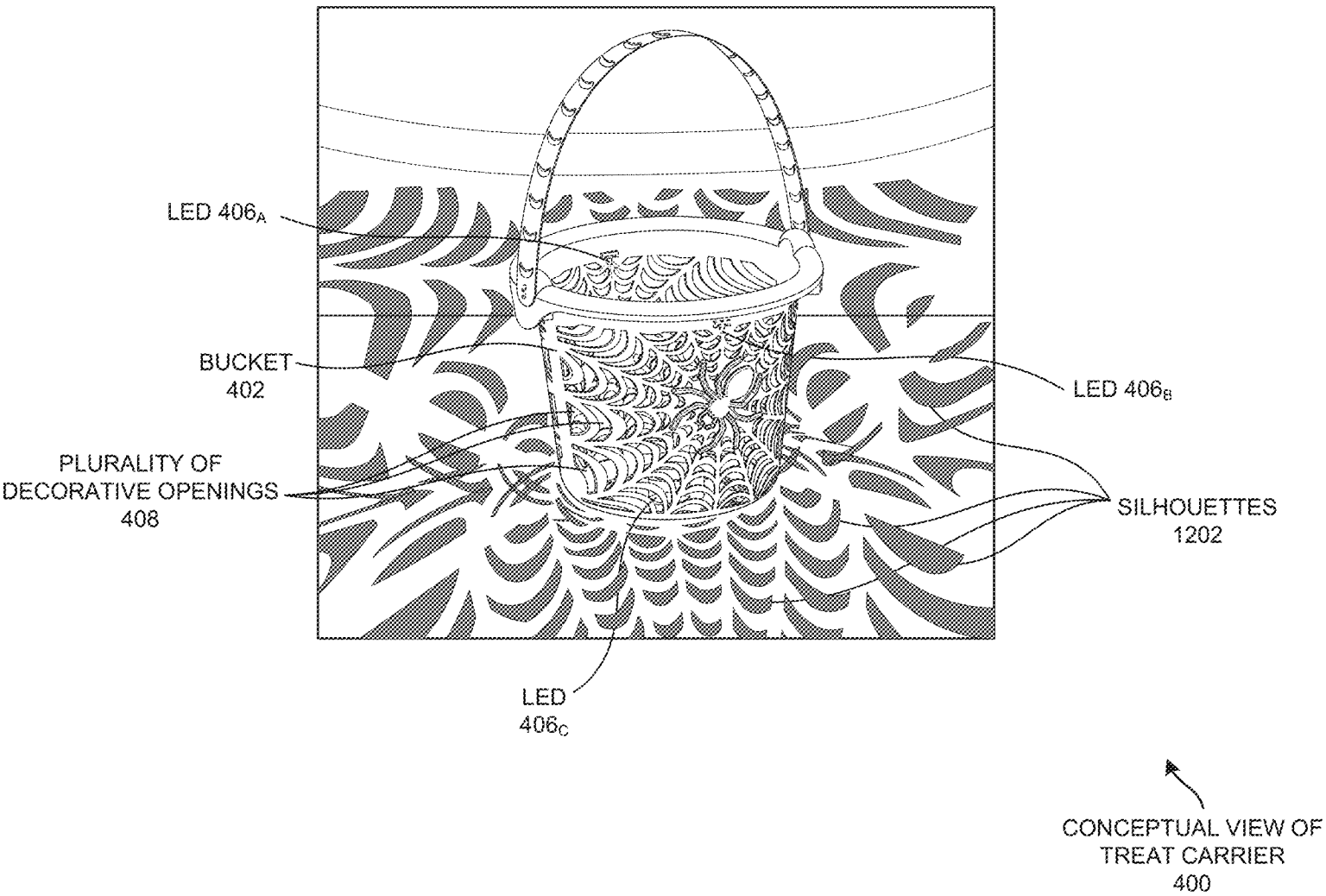
FIG. 12 is a conceptual view of the treat carrier of the embodiments of FIG. 1, FIG. 4, and FIG. 7 in which the LEDs are turned on which creates silhouetting around the bucket, according to one embodiment Other features of the present embodiments will be apparent from the accompanying drawings and from the detailed description that follows.

FIG. 12 is a conceptual view of the treat carrier 400 of the embodiments of FIG. 1, FIG. 4, and FIG. 7 in which the LEDs 406A-N are turned on which creates a plurality of silhouettes 1202 around the bucket 402, according to one embodiment.

FIG. 12 shows the conceptual view of the treat carrier 400 comprising the bucket 402, the light-emitting diodes 406A-C, the plurality of decorative openings 408 and a plurality of silhouettes 1202. As shown in FIG. 12, the LEDs 406A-N may be turned to a constant on setting which produces silhouettes of light as the light shines through the plurality of decorative openings 408. The silhouettes 1202 may be the shape of the plurality of decorative openings 408 or may be residual light shining through the bucket 402. The silhouettes 1202 may be multi-colored depending on the coloring of the refraction means (not shown) and the color of the bucket 402. The silhouettes 1202 may alert those around the carrier of the treat carrier 400 that there is a child walking and thus prevent accidents with children.

The dark, ghoulish elements of Halloween may be what excite most people about the holiday, but these elements may also present considerable risks and dangers for participants, especially children. Walking at night in the dark may be inherently dangerous, but it may be even more so on holiday nights. On holidays such as Halloween, drivers may be more likely to be under the influence and pedestrians may be more likely to be dressed in dark, hard-to-see clothing. Despite the considerable risks and dangers involved with walking in public on Halloween, children continue to dress in dark costumes and ignore the need for personal visual indicators. Children, while dressed in their Halloween attire, often fail to obey traffic and/or pedestrian laws and ordinances. Children may also often fail to use common sense such as looking both ways before crossing a road and/or using a crosswalk. These failures may result not only from a lack of knowledge of laws and the rules of the road, but also from the excitement that Halloween festivities may bring. Children may be playing with friends, searching for their next house to trick-or-treat at, and/or running around aimlessly as a result of their elevated blood sugar.

As a result of failing to properly obey the rules of the road and/or use common walking sense, children may become the victim of traffic accidents. The embodiments of FIGS. 1-12 may remedy the risks involved with Halloween night and help to protect children from themselves and from the hidden dangers around them. The embodiments of FIGS. 1-12 produce lighting that may be seen by those driving automobiles, which may increase the likelihood the child is seen by the driver which may decrease the likelihood of an accident. The embodiments of FIGS. 1-12 may enable children to supplant the use of items such as hand held flash lights, headlamps, reflective vests, and/or reflective headwear because it provides the user with both a receptacle to place their gathered goods and a light source which makes themselves more visible to others. The embodiments of FIGS. 1-12 may enable users to have a free hand with using the device, which may assist with candy retrieval and/or may allow a chaperone to hold the hand of the child, which further protects them from unforeseen danger.

Although the present embodiments have been described with reference to specific example embodiments, it will be evident that various modifications and changes may be made to these embodiments without departing from the broader spirit and scope of the various embodiments.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It may be appreciated that the various systems, methods, and apparatus disclosed herein may be embodied in a machine-readable medium and/or a machine accessible medium compatible with a data processing system (e.g., a computer system), and/or may be performed in any order.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

The invention claimed is:

1. A treat carrier comprising:

a bucket formed of a translucent material in which a light source within the bucket illuminates the bucket interiorly and exteriorly, wherein the bucket is primarily formed through a single mold process in which the translucent material is manipulated in a form of the bucket, and wherein a plurality of decorative openings along a surface of an exterior wall to permit the light to pass through to a region exterior to the bucket, and which generates a decorative projected silhouette that emanates from the exterior wall of the bucket and projects to areas surrounding the bucket;

at least one light-emitting diode affixed in an interior portion of a top region of the bucket serving as the light source, wherein the at least one light-emitting diode is placed within a cavity formed through the single process mold;

an electrical wire that transposes within a straw cavity of an upper lining of the bucket; and a battery source that provides an electrical current that is carried through the electrical wire to the at least one light-emitting diode affixed to the interior portion of the top region of the bucket.

2. The treat carrier of claim 1 wherein there are multiple light emitting diodes in respective cavities which bisect a sectional plane of a circular opening of the bucket and which are approximately 1 pi radians apart from each other.

3. The treat carrier of claim 2 further comprising:

a refraction means on the at least one light-emitting diode to bend a light from the at least one light-emitting diode;

wherein the refraction means on each of the multiple light-emitting diodes bend the light from each of the multiple light-emitting diodes to a focus of the interior of the bucket while permitting the entirety of the bucket to luminesce through the translucent material in which the light from the multiple light-emitting diodes illuminates the bucket interiorly and exteriorly.

4. The treat carrier of claim 3 further comprising: a plurality of decorative openings formed during the single mold process in which the translucent material is manipulated in the form of the bucket to restrict passage of a holiday item outside the bucket, and wherein the refraction means to bend a light from the multiple light-emitting diodes in a downward fashion.

5. The treat carrier of claim 4 wherein the plurality of decorative openings transform the light into a kaleidoscopic pattern around a child carrying the bucket during a holiday.

6. The treat carrier of claim 5 wherein the bucket further comprises a solid decorative object that is transposed on the exterior wall that blocks the light from passing through the solid decorative object.

7. The treat carrier of claim 1 wherein the at least one light-emitting diode has an off mode, a constant on mode, and a flashing mode.

8. The treat carrier of claim 7 wherein a button toggles the light-emitting diode between the off mode, the constant on mode, and the flashing mode.

9. The treat carrier of claim 1 wherein a cover encloses the straw cavity to encase and protect the electrical wire.

10. The treat carrier of claim 1 wherein a handle is attached to one of the bucket, the top region of the circular opening of the bucket, and an upper rim via a revolute joint.

11. The treat carrier of claim 1 wherein the battery source and the at least one light-emitting diode is encased within a housing.

12. The treat carrier of claim 1 wherein at least one frame encases each of the at least one light-emitting diode wherein the at least one frame is formed to fit into cavities of the apparatus in which the at least one light-emitting diode is affixed.

13. A treat carrier comprising:

a bucket comprising a plurality of decorative openings wherein the openings do not allow a holiday item to pass through;

a upper rim formed around a perimeter of a circular opening of the bucket;

a straw cavity below the upper rim;

a first electrical wire affixed within the straw cavity across the perimeter of the circular opening of the bucket;

a first and second cavity oppositely formed in an interior portion of a top region of the circular opening of the bucket;

a battery source affixed to the bucket;

a first light-emitting diode embedded within the first cavity, wherein the first electrical wire carries power from the battery source to the first light-emitting diode; and wherein the first light-emitting diode has a refraction means that bends light to a focus of the interior of the bucket; and a second light-emitting diode embedded within the second cavity, wherein the first electrical wire carries power from the battery source to the second light-emitting diode; and wherein the second light-emitting diode has a refraction means that bends light to the focus of the interior of the bucket.

14. The treat carrier of claim 13 wherein a cover encloses the straw cavity to protect the electrical wire.

15. The treat carrier of claim 14 wherein the bucket, the upper rim, and the cover are formed of a single mold translucent material.

16. The treat carrier of claim 13 wherein a handle is attached to one of the bucket, the top region of the circular opening of the bucket, and the upper rim via a revolute joint.

17. The treat carrier of claim 13 wherein a second electrical wire carries power from the battery source to a third light-emitting diode located at the center region of the surface of the bucket.

18. The treat carrier of claim 17 wherein a button toggles the first light-emitting diode, the second light-emitting diode, and the third light-emitting diode between an off mode, a constant on mode, and a flashing mode.

19. The treat carrier of claim 17 wherein a first frame partially encases the first light-emitting diode, a second frame partially encases the second light-emitting diode, and a third frame partially encases the third light-emitting diode;

wherein the first frame, the second frame, and the third frame are formed to fit into the first cavity, the second cavity, and a third cavity respectively.

20. The treat carrier of claim 13 further comprising a third light-emitting diode located at the center region of the surface of the bucket;

wherein the third light-emitting diode is powered by a second battery source located at the center region of the bucket;

wherein a second button is located at the center region of the bucket;

wherein the second button toggles the third light-emitting diode between an off mode, a constant on mode, and a flashing mode.

21. The treat carrier of claim 13 wherein the battery source and any one of the first light-emitting diode and the second light-emitting diode are encased within a housing.

22. A method of manufacturing a treat carrier comprising:

forming a bucket through a single mold process in which a translucent material is manipulated in a form of the bucket, wherein the translucent material is a material in which a light within the bucket illuminates the bucket interiorly and exteriorly;

affixing a plurality of light-emitting diodes in an interior portion of a top region of the bucket;

bending the light from each of the light-emitting diodes in a inward fashion; and channeling an electrical wire in a straw cavity of an upper lining of the bucket from a battery source to the plurality of light-emitting diodes.

23. The method of manufacturing a treat carrier claim 22 further comprising:

bending the light from each of the light-emitting diodes to a center region of a surface of the bucket while permitting the entirety of the bucket to luminesce through the translucent material in which the light from the plurality of light-emitting diodes illuminates the bucket interiorly and exteriorly.

24. The method of manufacturing a treat carrier claim 22 further comprising:

forming a plurality of decorative openings during the single mold process in which the translucent material is manipulated in the form of the bucket to restrict passage of a holiday item outside the bucket;

permitting the light to pass through the plurality of decorative openings to a region exterior to the bucket; and causing the light to scatter into a kaleidoscopic pattern around a child carrying the bucket during a holiday when permitting the light to pass through the plurality of decorative openings to a region exterior to the bucket.

* * * * *